United States Patent [19]

Onoda et al.

[11] Patent Number: 4,972,227

[45] Date of Patent: Nov. 20, 1990

[54] PROCESS KIT AND POSITIONING MECHANISM FOR THE PROCESS KIT

[75] Inventors: Shigeyoshi Onoda, Yokohama; Akihiro Nomura, Kawasaki; Morikazu Mizutani, Tokyo; Shinji Kanemitsu, Ichikawa; Mototada Toriumi, Yokohama; Fumio Nishino, Tokyo, all of Japan

[73] Assignee: Canon Kabushiki Kaisha, Tokyo, Japan

[21] Appl. No.: 387,372

[22] Filed: Jul. 31, 1989

Related U.S. Application Data

[63] Continuation of Ser. No. 62,331, Jun. 9, 1987, abandoned, which is a continuation of Ser. No. 787,260, Oct. 15, 1985, abandoned, which is a continuation of Ser. No. 463,825, Feb. 4, 1983, abandoned.

[30] Foreign Application Priority Data

Feb. 12, 1982 [JP] Japan ..... 57-21751

[51] Int. Cl.[5] ..... G03G 15/00; G03G 15/04; G03G 21/00

[52] U.S. Cl. ..... 355/210; 355/232

[58] Field of Search ..... 355/200, 210, 211, 212, 355/232

[56] References Cited

U.S. PATENT DOCUMENTS

| | | | |
|---|---|---|---|
| 3,955,888 | 5/1976 | Onoda et al. | 355/1 |
| 3,966,316 | 6/1976 | Pfeifer et al. | 355/200 |
| 3,985,436 | 10/1976 | Tanaka et al. | 355/200 |
| 4,128,079 | 12/1978 | Suzuki | 118/658 |
| 4,236,807 | 12/1980 | Kuehnle | 355/210 |
| 4,254,202 | 3/1981 | Matsumoto et al. | 430/120 |
| 4,386,838 | 6/1983 | Hirabayashi et al. | 355/200 |
| 4,386,841 | 6/1983 | Wakao et al. | 355/200 |
| 4,470,689 | 9/1984 | Nomura et al. | 355/211 |
| 4,500,195 | 2/1985 | Hosono | 355/208 |
| 4,566,777 | 1/1986 | Honda et al. | 355/297 |
| 4,575,221 | 3/1986 | Onoda et al. | 355/200 |
| 4,591,258 | 5/1986 | Nishino et al. | 355/200 |

FOREIGN PATENT DOCUMENTS

| | | |
|---|---|---|
| 2817148 | 4/1978 | Fed. Rep. of Germany . |
| 1490770 | 11/1977 | United Kingdom . |

*Primary Examiner*—Fred L. Braun

*Attorney, Agent, or Firm*—Fitzpatrick, Cella, Harper & Scinto

[57] ABSTRACT

A process kit includes a support member having a photosensitive member integrally mounted thereon together with process elements for acting on the photosensitive member. The support member is mountable on and removable from a main image forming apparatus having an optical system for projecting an image onto the photosensitive member. The support member has a positioning element for engaging the optical system in order to position the optical system accurately with respect to the photosensitive member. This configuration permits sharply formed images to be formed on the photosensitive member after removal and remounting of the process kit.

32 Claims, 6 Drawing Sheets

PROCESS KIT AND POSITIONING MECHANISM FOR THE PROCESS KIT

This application is a continuation of application Ser. No. 07/062,331 filed June 9, 1987, now abandoned which is a continuation of Ser. No. 06/787,260 filed Oct. 15, 1985 now abandoned, which is a continuation of Ser. No. 463,825, filed Feb. 4, 1983, now abandoned.

BACKGROUND OF THE INVENTION

1. Field of the Invention

This invention relates to a process kit removably mountable with respect to an apparatus body and a mechanism for coupling the process kit and the apparatus body.

2. Description of the Prior Art

Generally, in a copying apparatus using the electrophotographic method, when it is used for a long time, there occurs the necessity of replacement of the photosensitive member, supply or replacement of the developer, cleaning of the charging wire or other adjustment or replacement, and such maintenance works are carried out by professional servicemen. However, in order to make the copying apparatus operate always in good conditions, there has been proposed a technique of carrying out such maintenance works without resorting to the professional servicemen. As an example of such technique, there is a method whereby a combination of various constituent members such as a charger, a developing device, a photosensitive member, etc. contained in the apparatus is simply replaced with a new one. If a construction which enables such replacement of a process kit is adopted, it will become possible to use the same apparatus body multifunctionally by preparing a plurality of kits in accordance with the usages and inserting a kit matching a desired usage into the apparatus body.

The maintenance and usages are widened by the user who has a copying apparatus so handling the kit, while there may arise a problem in the handling of the kit. The problem is that the kit must always be inserted into a proper position relative to the apparatus body. Particularly, in an apparatus wherein an optical system is disposed on the body side, the distance or the like between the optical system and the photosensitive member is affected by the state of the inserted process kit in the apparatus body.

SUMMARY OF THE INVENTION

It is an object of the present invention to insert a process kit accurately into a predetermined position in an apparatus body to thereby enable image information to be sharply imaged on a photosensitive member in the process kit.

The present invention which achieves the above object enables a process kit removably mountable with respect to an apparatus body to be directly coupled to optical system means in the apparatus body or to a portion formed integrally with the optical system.

Some embodiments of the present invention will hereinafter be described in detail by reference to the accompanying drawings.

DESCRIPTION OF THE PREFERRED EMBODIMENTS

Figure 1:
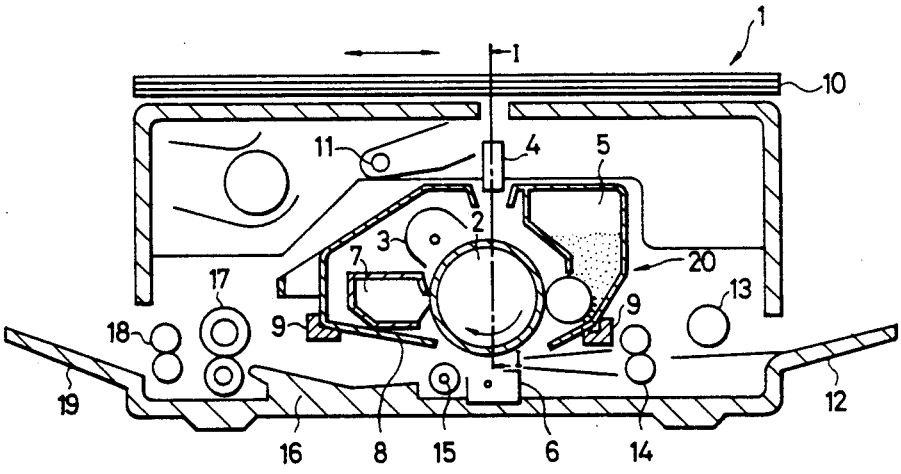
FIG. 1 is a cross-sectional view of a copying apparatus to which the present invention is applicable.

Referring to FIG. 1, it is a side view showing the essential portions of an electrophotographic copying apparatus to which an embodiment of the present invention is applied.

The apparatus 1 is a copying apparatus using the electrophotographic method. A photosensitive drum 2 comprising a photoconductive layer provided on a conductive drum substrate is supported for rotation in the direction of arrow. Around this drum 2, a corona discharger 3, a short focus optical element array 4, a developing device 5, a transfer corona discharger 6 and a cleaning device 7 are disposed in the direction of rotation of the drum. In this apparatus 1, the photosensitive drum 2, the discharger 3, the developing device 5 and the cleaning device 7 are integrally supported as a process kit 20 by a housing 8. The housing 8 is guided and supported by guide rails 9 secured to the apparatus body and is removably mounted with respect to the apparatus body.

In the above-described copying apparatus, the surface of the photosensitive drum 2 is uniformly charged to a predetermined polarity by the corona discharger 3, and then an original on a reciprocally movable original carriage 10 on top of the apparatus body is illuminated by a lamp 11, and the reflected light therefrom is projected upon the drum 2 through the element array 4, whereby a latent image is formed on the surface of the drum. The formed latent image is developed by the developing device 5 and the developed image is transferred to a transfer medium by the transfer corona discharger 6. The transfer medium is supplied to a transfer medium supply tray 12 manually by the operator and is conveyed therefrom to a transfer station through a conveyor roller 13 and timing rollers 14. After the image transfer, the transfer medium is separated from the drum 2 by separator means 15 and transported to a fixing device through a movement path 16 for fixation of the transferred image, whereafter it is discharged onto a paper discharge tray 19 through discharge rollers 18.

Figure 2:
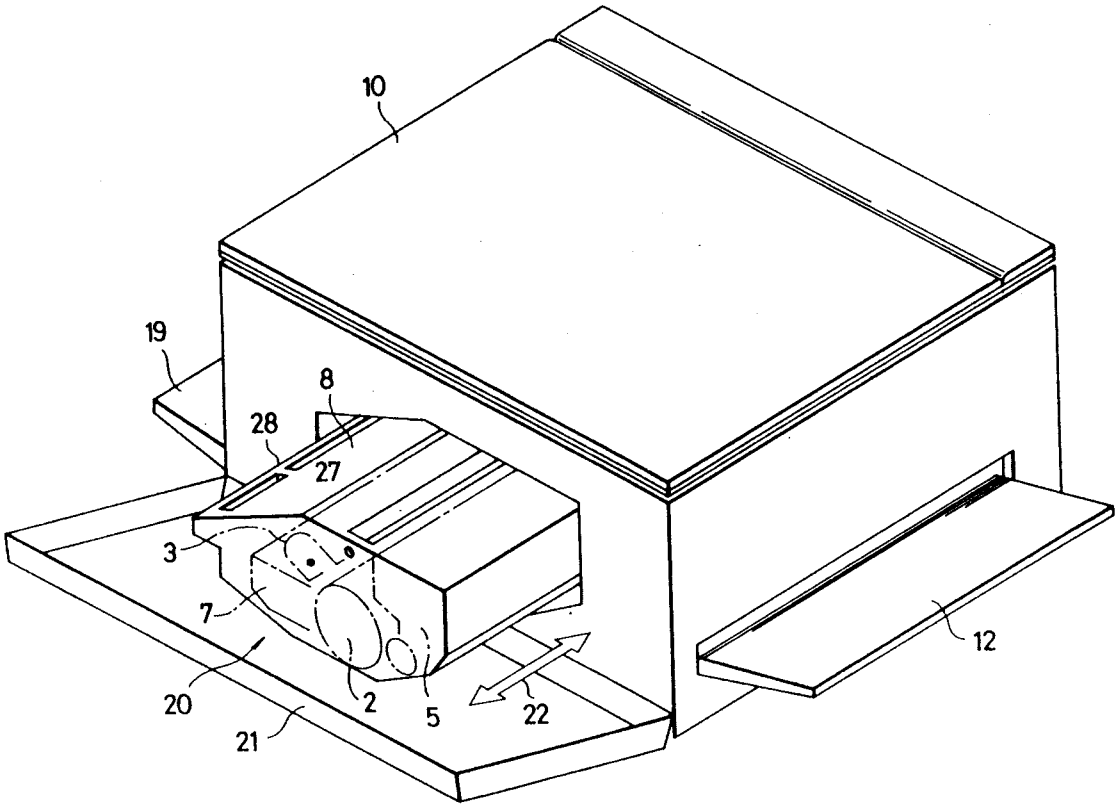
FIG. 2 is a perspective view of the copying apparatus showing the mount-dismount relationship between a process kit and the apparatus body.

FIG. 2 is a perspective view showing the mount-dismount relationship of the process kit 20 with the apparatus body. The mounting-dismounting of the process kit including the photosensitive drum may be accomplished by opening the front door 21 of the apparatus body and manually drawing out the housing 8. The arrow 22 in FIG. 2 indicates the direction of the movement of the housing resulting from the mounting-dismounting of the process kit.

Figure 3:
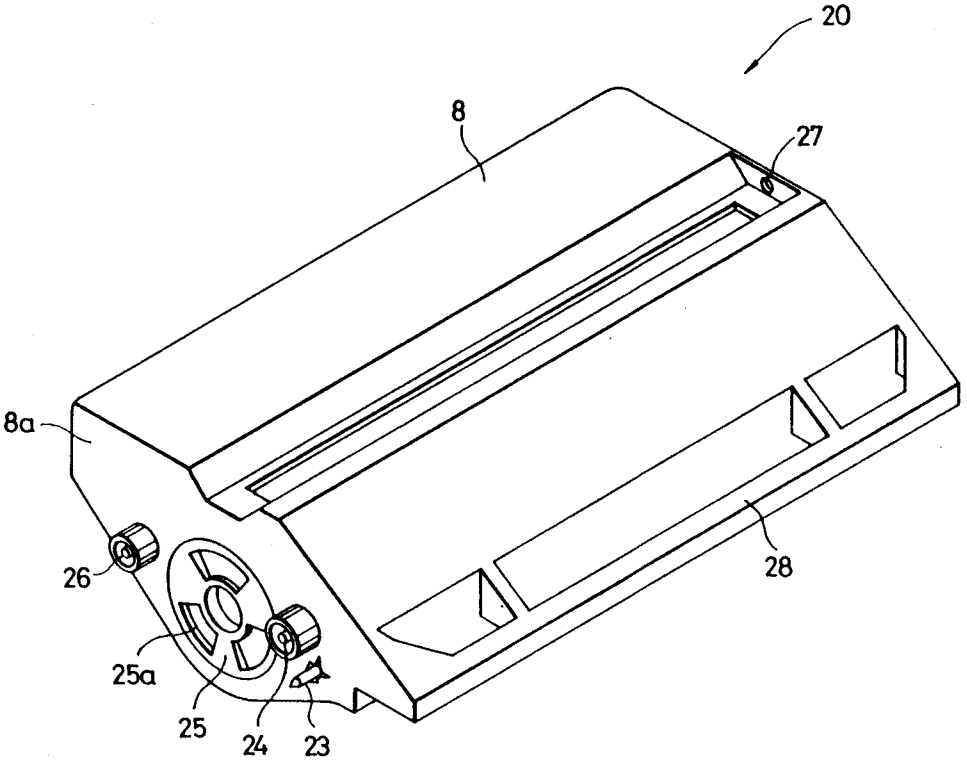
FIG. 3 is a perspective view of the process kit.

FIG. 3 is a perspective view of the process kit 20. This side of FIG. 3 is the portion which becomes the inner part when the kit has been inserted into the apparatus body. A positioning pin 23 for properly correcting the position of the kit inserted into the apparatus body and a connection 24 for supplying a high voltage to the charger 3 are provided on the inner end surface 8*a* of the housing 8 and greatly jut out from the end surface 8*a* to provide the convex portion of the present invention. In addition, a drum bearing portion 25 for driving the photosensitive drum 2 and a connector 26 for applying a bias voltage to the developing device 5 are provided on the end surface 8*a* of the housing 8. The concave-convex portion of the bearing portion 25 fits to the concave-convex portion of the apparatus body and at the same time, transmits the drive force of the apparatus body to the drum 2 by a construction which will hereinafter be described.

An example of the coupling between the process kit 20 and the optical system means of the apparatus body will hereinafter be described by reference to FIGS. 4 and 5.

Figure 4:
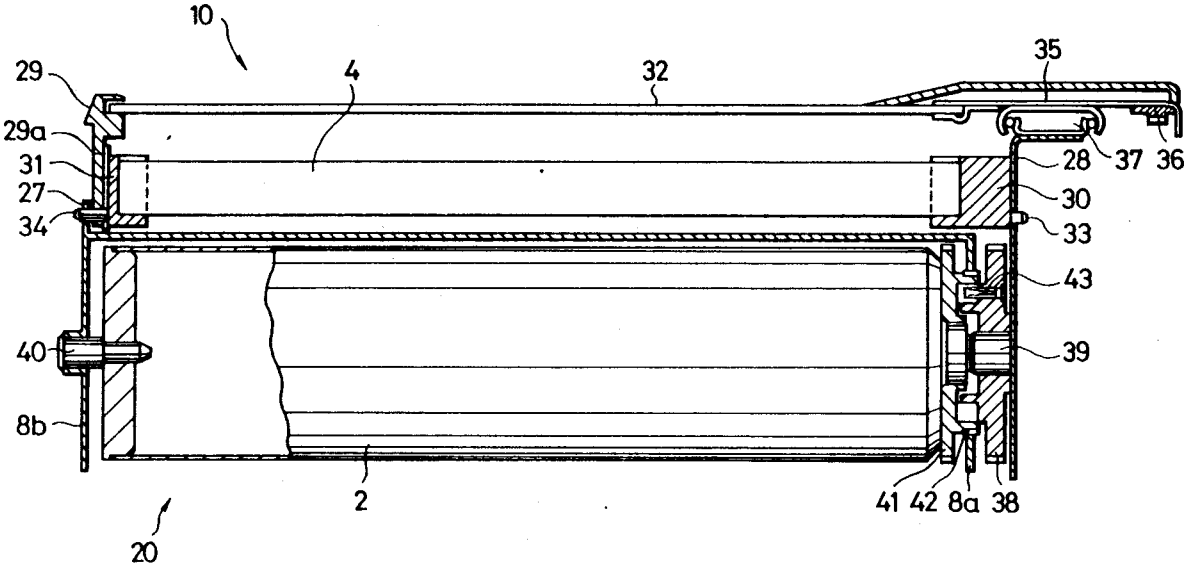
FIG. 4 is a cross-sectional view showing the coupled condition of the apparatus body and the process kit.

FIG. 4 shows the process kit 20 as inserted in the apparatus body and is a cross-sectional view taken along line I—I of FIG. 1. As shown, the short-focus optical element array 4 disposed parallel to the rotary shaft of the photosensitive drum 2 is secured to the rear side plate 28 and the front side plate 29 of the apparatus body through support blocks 30 and 31. The support blocks 30 and 31 fix the element array 4 exactly in a predetermined spaced apart relationship with the glass plate 32 of the original carriage, and the block 30 keeps its positional accuracy with a pin 33 fitted in an opening in the rear side plate 28. On the other hand, the block 31 is fixed with a pin 34 fitted in an opening in a side plate 29*a* discrete from the front rear plate 29. This block 31 also keeps its positional accuracy by the pin 34 similarly to the block 30. The pin 34 acts as positioning means for element array 4, and, as seen in FIG. 5, the opening in side plate 29 is a slot extending in a direction that positions pin 34 substantially parallel to the optical axis of element array 4.

Now, the original carriage 10 is reciprocated on the element array 4 by bringing into mesh engagement with a pinion gear (not shown) a rack 36 secured to the other end of the support 35 of the glass plate 32 and rotating this pinion. This side of the original carriage 10 is moved by the glass plate 32 sliding on the recess of the front side plate 29 and the inner side of the original carriage is in a condition in which it is movable to the apparatus body side through an Accuride rail (tradename) 37.

In the conventional apparatus, the positioning of the removably mountable photosensitive drum on that side on which the photosensitive drum is drawn out during the mounting or dismounting thereof has been accomplished by the use of a separate core positioning plate independent of the front side plate, and the core positioning plate has been fixed to the front side plate by means of a plurality of screws. According to this example of the prior art, the distance between the optical system means and the center of the photosensitive drum is greatly affected by the dimensional accuracy of both the front side plate and the core positioning plate. Accordingly, in an optical system whose depth of focus is short, a high degree of machining accuracy is required in the machining of the front side plate and the core positioning plate.

In contrast, in the present invention, the housing end surface 8*b* of the kit 20 which serves also as the core positioning plate of the center of rotation of the photosensitive drum is positioned while directly fitting to the centering pin 34 for the optical element array 4 and therefore, it is possible to eliminate the reduction in positional accuracy which results from the conventional core positioning plate. On the other hand, on the inner side of the process kit, the rear side plate 28 has a positioning pin 33 for the block 30 and a drive shaft 39 of a drum gear which provides the rotative drive source of the photosensitive drum 2. Therefore, the pin 33 and the drive shaft 39 have their mounted position set on the same side plate, and a gear 38 mounted on this drive shaft directly acts on the photosensitive drum 2 of the process kit and thus, it may be said that the axis of rotation of the photosensitive drum 2 substantially lies on the rear side plate in which the pin 33 exists. Thus, on the inner side as well as on this side of the process kit, it becomes possible to set the position of the center of rotation of the photosensitive drum 2 with high positional accuracy relative to the optical system.

The driving of the photosensitive drum 2 will now be described. This side of the drum 2 is rotatably supported on a shaft 40 fixed to the housing 8*b* of the kit. On the other hand, on the other side of the drum, a gear 41 secured to the side surface of the drum 2 is supported on a bearing member 42 for rotation relative to the housing 8*a* of the kit. The gear 41, as shown in FIG. 4, has three sector-shaped recesses 25*a*, and pins 43 on the apparatus body side fit in these recesses, and the gear 41 on the kit side is driven by the gear 38 of the apparatus body with a result that the drum 2 is rotated. The gear 41 on the kit side is for driving the sleeve of the developing device disposed in the kit. Of course, the movable portion of the cleaning device can also be driven by the gear 41.

Figure 5:
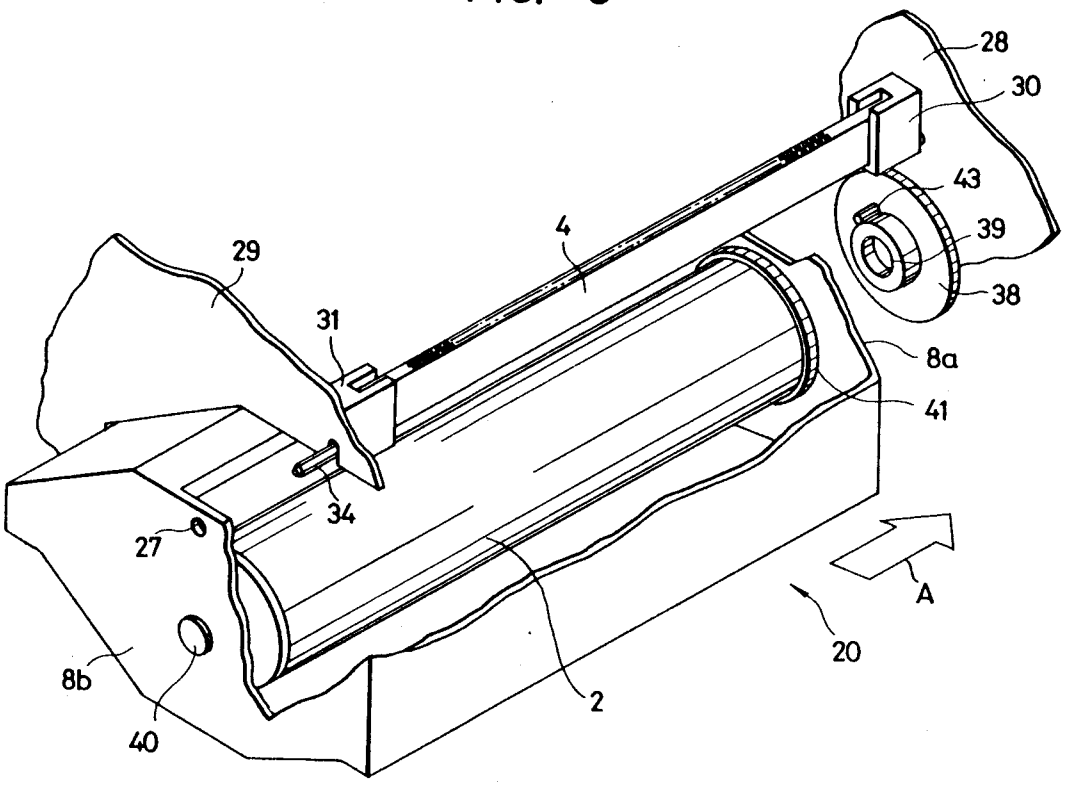
FIG. 5 is a perspective view showing the process kit being inserted.

FIG. 5 is a perspective view showing the process kit being loaded into the apparatus body. If the kit 20 is further pushed in the direction of arrow A from its shown position by the guide 9 of FIG. 1, the concave-convexity of the gear 41 supporting the photosensitive drum 2 fits to the concave-convexity of the gear 38 on the apparatus body side and the gear 41 is supported at a predetermined position while, at the same time, the positioning pin 34 of the optical system directly fits in an aperture 27 in the other end of the kit, thus completing the positioning. As is apparent from FIG. 5, the gear 41 on the kit side acts also as a support for positioning the entire process kit and stopping the moment by which the kit is axially rotated.

Figure 6:
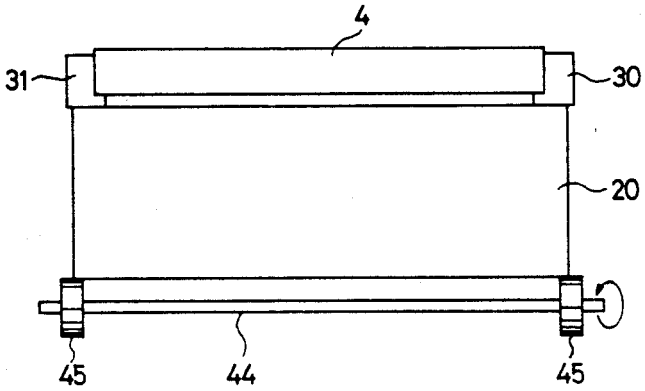
FIG. 6 is a side view of another embodiment of the present invention.

In the present invention, it is a condition that the process kit has the photosensitive drum, but the developing device, the cleaning device, etc. may be suitably provided. Also, to position the process kit relative to the optical system, the entire kit may be forced upwardly relative to the blocks 30 and 31 by rotation of eccentric cams and brought into direct contact with the blocks, as shown in FIG. 6, In FIG. 6, reference numeral 44 designates a shaft on which eccentric cams 45 are supported. By rotating this shaft 44, the removably mountable process kit 20 may be directly urged against the support blocks 30 and 31 of the optical means and the distance between the process kit and the optical system means may be set.

As described above, according to the present invention, not only the removably mountable process kit can be positioned relative to the optical system means by a least possible number of parts, but also the accuracy of the optical system and the photosensitive drum can be more enhanced and thus, it becomes possible to prevent the reduction in quality of image which would result from the non-sharpness of formed image. Particularly, where the position of the central axis of the photosensitive drum is set relative to the optical system means through another independent member such as the conventional core positioning plate, predetermined mounting accuracy cannot be maintained due to the deformation or the like of the diameter resulting from deterioration of the threaded hole in the independent member, whereas according to the present invention, there is no possibility of such reduction in accuracy. Incidentally, the optical system means is not limited to the optical element array, but for example, in an optical system using mirror scanning, the housing of this scanning means may be the object to be centered and particularly, a housing parallel to the optical axis or near it is suitable. Of course, of the housing of the scanning optical system, the exit portion for image light seems to be most suitable. Further, the present invention is applicable not only to copying apparatus but also to facsimile apparatus and other image forming apparatus.

Figure 7:
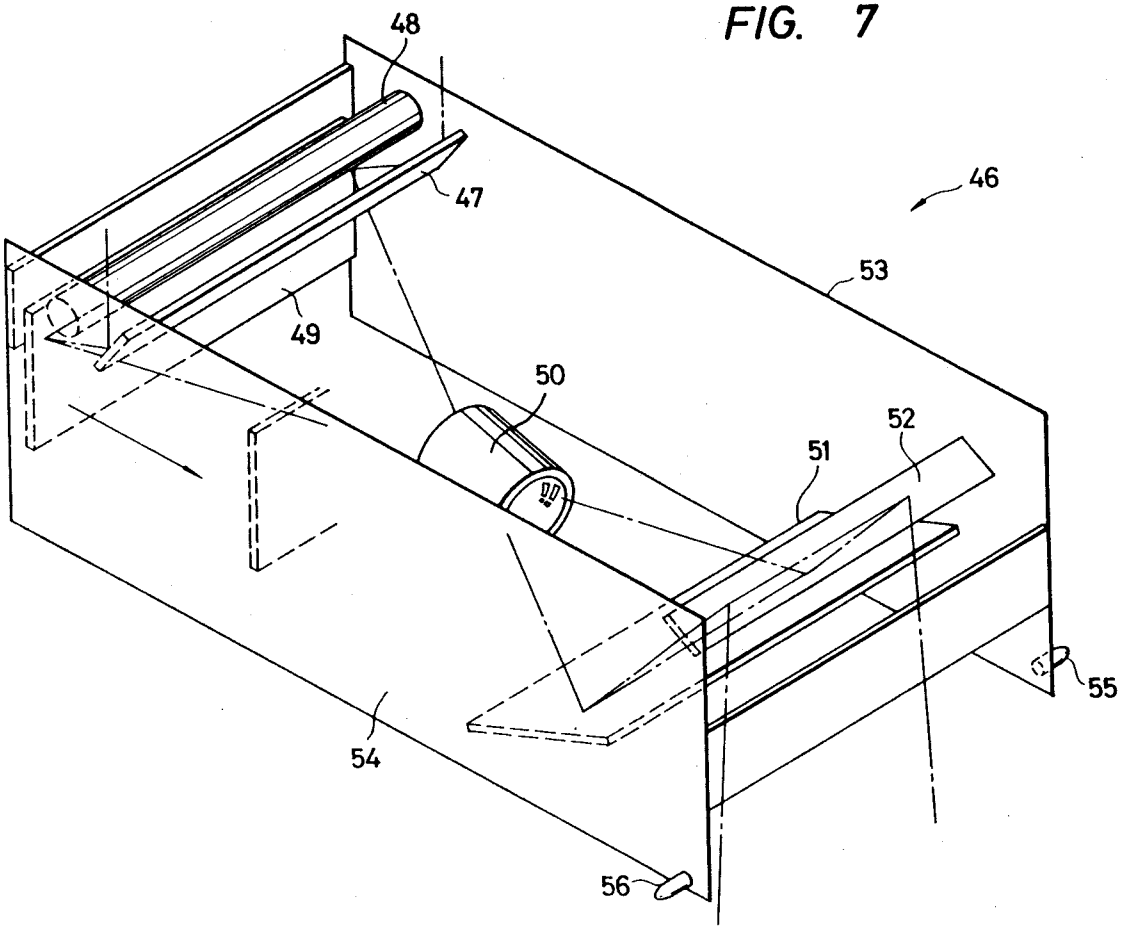
FIG. 7 is a perspectivc view of another embodiment of optical system means.

FIG. 7 shows an embodiment in which a movable mirror is adopted as the optical system means. In FIG. 7, the optical system means 46 has a first scanning mirror 47 for scanning the entire area of the well-known fixed original carriage, a lamp 48 movable with the mirror 47, and a second scanning mirror 49 movable in the same direction as the first mirror 47 at ½ of the speed of the first mirror 47 and by ½ of the distance of movement of the first mirror. The image of the original scanned by these scanning mirrors is projected upon the photosensitive member via a condenser lens 50 and first and second stationary mirrors 51 and 52. The first and second scanning mirrors are guided by and moved on rails, not shown.

In FIG. 7, reference numerals 53 and 54 designate side plates for supporting the mirrors and lens integrally. The side plates 53 and 54 are respectively provided with pins 55 and 56 corresponding and similar to the pins 33 and 34 in the above-described embodiment. When the copying apparatus is to be assembled, the pin 55 may be fitted in a hole or a recess formed in a side plate of the apparatus body which supports a rotatable member directly connected to the shaft of the photosensitive drum of the process kit. The other pin 56 is engaged in the hole 27 (FIGS. 3 and 4) of the process kit in the same manner as described above.

If the optical system means in constructed in the form of a unit as shown in FIG. 7, it will become possible to simplify the process of assembly. The side plate 53 of the optical system means located on the downstream side with respect to the direction of insertion of the process kit may be a side plate fixed to the apparatus body and supporting a rotatable member directly connected to the rotary shaft of the photosensitive drum of the process kit and further supporting other members. In such case, only the pin 56 is necessary and engaged in the hole 27 formed in the housing of the process kit.

Now, where the pins 55 and 56 are not provided, the housing of the process kit may be urged against the side plates 53 and 54, as shown in FIG. 6. Also, a combination of only stationary mirrors and condenser lens is conceivable as the optical system means and in such case, the apparatus is of the type in which the original carriage is movable.

The components of the process kit of the present invention are a photosensitive member and process means integrally provided as a unit, and the process means may be a combination of all or some of a corona discharger, a developing device, a transfer discharger, a cleaning device, etc. The present invention effectively acts, for example, even for a process kit having a photosensitive member and a developing device as components.

We claim:

1. A process kit removably mountable with respect to the body of an image forming apparatus that includes optical means for applying a light pattern to the process kit, said optical means having a positioning element for positioning said optical means at least in a direction substantially parallel to an optical axis of said optical means, said kit comprising:

a photosensitive member having a surface to be exposed to a light pattern by the optical means;

process means for acting on said photosensitive member for image formation using the light pattern; and a support structure for integrally supporting said photosensitive member and said process means, said photosensitive member and process means being mounted in said support structure at predetermined locations therein to form a unit, wherein said unit is movable for mounting in the image forming apparatus, and wherein said support structure includes engagement means provided at an end portion of the support structure with respect to a moving direction adapted to engage the positioning element of the optical means, wherein said optical means is mounted by said positioning element, and wherein said engagement means of the support structure and said positioning element of said optical means mutually engage so as to locate the optical means and the photosensitive means accurately with respect to each other.

2. A process kit according to claim 1, wherein said engagement means of the support structure and said positioning element of said optical means have complementary shapes to regulate movement in the direction of the optical axis.

3. A process kit removably mounted onto an image forming apparatus having an optical system, said process kit comprising:

a rotatable photosensitive member to which the optical information from said optical system is applied;

process means for acting on said photosensitive member;

a supporting member on which said photosensitive member and said process means are supported, said supporting member having a first positioning portion;

said first positioning portion being brought into direct engagement with a second positioning portion which supports said optical system and positions said optical system relative to said image forming apparatus as said process kit is mounted into a predetermined position in said image forming apparatus along an axial direction of said photosensitive member; and said first positioning portion of said process kit and said second positioning portion of said optical system cooperating so as to position said optical system at a predetermined position relative to said photosensitive member of said process kit.

4. A process kit according to claim 3 wherein said positioning portions comprise a recess and a projection which enters said recess in the direction in which the process kit is guided into said image forming apparatus.

5. A process kit according to claim 4 wherein said recess is an aperture formed on the support member for receiving a pin constituting the projection which supports the optical system.

6. A process kit according to claim 3 wherein said process means comprises a corona discharger for electrostatically charging the surface of said photosensitive member.

7. A process kit according to claim 3 wherein said process means comprises a developing device for developing a latent image formed on said photosensitive member.

8. A process kit according to claim 3 wherein said process means comprises a cleaning device for cleaning the surface of said photosensitive member.

9. A process kit according to claim 3, wherein said first and second positioning portions have complementary shapes to regulate movement of said process kit in a direction of an optical axis of said optical system.

10. A process kit according to claim 3, wherein said first and second positioning portions, which are mutually associated upon the mounting of said process kit, are provided at a first portion of said support member and a second portion of said optical system, respectively.

11. A mounting-dismounting mechanism for a process kit, wherein said kit has a rotatable photosensitive member and process means acting on said photosensitive member for image formation, and wherein said process kit is removably mounted in an image forming apparatus which includes a receiving portion for receiving and mounting the process kit, drive force transmitting means for transmitting a drive force to the process kit when the process kit is mounted in said apparatus, and optical system means for transmitting optical information onto a surface of the photosensitive member, wherein said optical system means includes first positioning means coupled to said optical system means for positioning said optical system means in at least a direction substantially parallel with an optical axis of said optical system means, said mounting-dismounting mechanism comprising:

a process kit housing for integrally supporting said photosensitive member and said process means at predetermined positions therein; drive force receiving means at least at a side end of said photosensitive member for receiving a drive force from the apparatus when the process kit is mounted to the image forming apparatus; and second positioning means fixed to said housing for engaging the positioning means of said optical system means when said process kit is moved for mounting in the image forming apparatus, wherein the first positioning means and the second positioning means cooperate so as to position said optical system means at a predetermined spacing relative to the photosensitive member of the process kit when said process kit is mounted in said image forming apparatus.

12. A mounting-dismounting mechanism according to claim 11, wherein said optical system means has a short-focus element array and a support arrangement therefor.

13. A mounting-dismounting mechanism according to claim 11, wherein said optical system means has a movable mirror, a condenser lens, and a support for holding the mirror and lens.

14. A mounting-dismounting mechanism according to claim 11, wherein said optical system means extends across a surface of said photosensitive member, said image forming apparatus including support means for supporting said drive force transmitting means and one end of said optical system means with a predetermined spacing therebetween, wherein when said process kit is moved for mounting in said image forming apparatus, said drive force receiving means and said drive force transmitting means cooperate so as to position said photosensitive member at the predetermined spacing relative to the optical system means when said process kit is mounted in said image forming apparatus.

15. A mounting-dismounting mechanism according to claim 11, wherein said first and second positioning means have complementary shapes to regulate movement in the direction of the optical axis.

16. A mounting-dismounting mechanism for a process kit, wherein said kit has a photosensitive member and process means acting on said photosensitive member for image formation, and wherein said process kit is removably mounted in an image forming apparatus which includes a receiving portion for receiving and mounting the process kit, drive force transmitting means for transmitting a drive force to the process kit when the process kit is mounted in said apparatus, and optical system means for transmitting optical information onto a surface of the photosensitive member which is fixed to the structure of the main body of said apparatus, wherein said optical system means includes first and second positioning members coupled to said optical system means for positioning said optical system means in at least a direction substantially parallel with an optical axis of said optical system means and a side structure for maintaining a space between the drive force transmitting means and the first positioning member of said optical means at a constant distance, said mounting-dismounting mechanism comprising:

a process kit housing for integrally supporting said photosensitive member and said process means at predetermined positions therein; drive force receiving means at a side end of said photosensitive member for receiving a drive force from the apparatus when the kit is mounted to the image forming apparatus, wherein said drive force receiving means on said photosensitive member engages said drive force transmitting means when said process kit is mounted in said apparatus; and a third positioning member fixed to said housing for engaging the second positioning member of said optical means when said process kit is mounted in the image forming apparatus, wherein the third positioning member and the second positioning member cooperate so as to establish a predetermined distance between the optical system means of the apparatus and the photosensitive member of the process kit when said process kit is mounted in said image forming apparatus.

17. A mounting-dismounting mechanism according to claim 16, wherein said optical system means has a short-focus element array and a support arrangement therefor.

18. A mounting-dismounting mechanism according to claim 16, wherein said optical system means has a movable mirror, a condenser lens and a support for holding the mirror and lens.

19. A mounting-dismounting mechanism according to claim 16, wherein said optical system means extends across the surface of said photosensitive member, said image forming apparatus including support means for supporting said drive force transmitting means and one end of said optical system with a predetermined spacing therebetween, wherein when said process kit is moved for mounting in said image forming apparatus, said drive force receiving means and said drive force transmitting means cooperate so as to position said photosensitive member at the predetermined spacing relative to the optical system when said process kit is mounted in said image forming apparatus.

20. A mounting-dismounting mechanism according to claim 16, wherein said second and third positioning members have complementary shapes to regulate movement in the direction of the optical axis.

21. A mounting-dismounting mechanism for a process kit, wherein said kit has a rotatable photosensitive drum and process means acting on said photosensitive drum for image formation, and wherein said process kit is removably mounted in an image forming apparatus which includes a receiving portion for receiving and mounting the process kit, drive force transmitting means for transmitting a drive force to the process kit when the process kit is mounted in said apparatus, an original carriage for carrying an original to be exposed, a short focus element array for projecting the exposed image of the original onto a surface of the photosensitive drum, wherein said short focus element array includes first positioning means coupled to said short focus element array for positioning said short focus element array in at least a direction substantially parallel with an optical axis of said short focus element array, said mounting-dismounting mechanism comprising:

a process kit housing for integrally supporting said photosensitive drum and said process means at predetermined positions therein; drive force receiving means at a side end of said photosensitive drum for receiving a drive force from the apparatus when the kit is mounted to the image forming apparatus; and second positioning means fixed to said housing for engaging the first positioning means when said process kit is moved for mounting in the image forming apparatus, wherein the first positioning means and the second positioning means cooperate so as to position said short focus element array at a predetermined spacing relative to the photosensitive drum of the process kit when said process kit is mounted in said image forming apparatus.

22. A mounting-dismounting mechanism according to claim 21, wherein said short focus element array extends across a surface of said photosensitive drum, said image forming apparatus including support means for supporting said drive force transmitting means and one end of said short focus element array with a predetermined spacing therebetween, wherein when said process kit is moved for mounting in said image forming apparatus, said drive force receiving means and said drive force transmitting means cooperate so as to position said photosensitive member at the predetermined spacing relative to the short focus element array when said process kit is mounted in said image forming apparatus.

23. A mounting-dismounting mechanism according to claim 21, wherein said first and second positioning means have complementary shapes to regulate movement in the direction of the optical axis.

24. A mounting-dismounting mechanism for a process kit, wherein said kit has a rotatable photosensitive member and process means acting on said photosensitive member for image formation, and wherein said process kit is removably mounted in an image forming apparatus which includes a receiving portion for receiving and mounting the process kit, guide means for guiding movement of the process kit when the process kit is mounted to the receiving portion, drive force transmitting means for transmitting a drive force to the process kit when the process kit is mounted in said receiving portion, an optical system for transmitting optical information onto a surface of the photosensitive member and including a first positioning portion coupled to said optical system for positioning said optical system in at least a direction substantially parallel with an optical axis of said optical system, said mounting-dismounting mechanism comprising:

a process kit housing for integrally supporting said photosensitive member and said process means at predetermined positions therein; and a second positioning portion fixed to said housing for engaging the first positioning portion of said optical system, said second positioning portion on said housing being brought by guide mounting movement of said kit into engagement with said first positioning portion of said optical system so as to locate the optical system and the photosensitive member accurately with respect to each other in said receiving portion when said process kit is mounted in said image forming apparatus.

25. A mechanism according to claim 24 wherein said positioning portions comprise a recess and a projection which enters said recess in the direction in which the kit is guided into said receiving portion.

26. A mechanism according to claim 25 wherein said recess is an aperture formed on the housing of the kit for receiving a pin constituting the projection.

27. A mechanism according to claim 24 wherein said process means comprises a corona discharger for electrostatically charging the surface of said photosensitive member.

28. A mechanism according to claim 24 wherein said process means comprises a developing device for developing a latent image formed on said photosensitive member.

29. A mechanism according to claim 24 wherein said process means comprises a cleaning device for cleaning the surface of said photosensitive member.

30. A mounting-dismounting mechanism according to claim 24, wherein said optical system extends across a surface of said photosensitive member, said image forming apparatus including support means for supporting said drive force transmitting means and one end of said optical system with a predetermined spacing therebetween, wherein when said process kit is moved for mounting in said image forming apparatus, said drive force receiving means and said drive force transmitting means cooperate so as to position said photosensitive member at the predetermined spacing relative to the optical system when said process kit is mounted in said image forming apparatus.

31. A mounting-dismounting mechanism according to claim 24, wherein said first and second positioning portions have complementary shapes to regulate movement in the direction of the optical axis.

32. A mounting-dismounting mechanism for a process kit according to any of claims 1, 11, 16, 21 or 24, wherein said process kit is mounted onto or dismounted from said image forming apparatus along a rotational axis of said photosensitive member.

* * * * *